US005593152A

United States Patent [19]

Wirth et al.

[11] Patent Number: 5,593,152

[45] Date of Patent: Jan. 14, 1997

[54] SHEET MEDIA SUPPLY TRAY ORIENTS SHEETS TO REGISTRATION POSTS IN IMAGING APPARATUS

[75] Inventors: Henry G. Wirth; Mark A. Bobb, both of Rochester, N.Y.

[73] Assignee: Eastman Kodak Company, Rochester, N.Y.

[21] Appl. No.: 398,207

[22] Filed: Mar. 2, 1995

[51] Int. Cl.[6] ..... B65H 9/12

[52] U.S. Cl. ..... 271/241; 271/162; 271/164

[58] Field of Search ..... 271/162, 164, 271/241

[56] References Cited

U.S. PATENT DOCUMENTS

| | | | |
|---|---|---|---|
| 4,032,137 | 6/1977 | Katayama et al. | 271/164 |
| 5,348,284 | 9/1994 | Ishihama et al. | 271/164 |
| 5,364,088 | 11/1994 | Maruyama et al. | 271/162 |

FOREIGN PATENT DOCUMENTS

| | | | |
|---|---|---|---|
| 0375411 | 6/1990 | European Pat. Off. | 271/241 |
| 57-38236 | 3/1982 | Japan | 271/162 |
| 0193833 | 7/1990 | Japan | 271/162 |
| 403098927 | 4/1991 | Japan | 271/162 |
| 2127386 | 4/1984 | United Kingdom | 271/162 |

*Primary Examiner*—Karen B. Merritt
*Assistant Examiner*—Douglas Hess
*Attorney, Agent, or Firm*—Milton S. Sales

[57] ABSTRACT

Imaging apparatus includes a sheet supply tray having a width alignment rail and a registration member against which the side of a received stack of sheets abuts when the stack is fully received in the imaging apparatus. The tray is urged toward the registration member as the sheet supply tray is being received in the imaging apparatus, and is held against the resilient force until the sheet supply tray is substantially fully received in the imaging apparatus to keep the received stack of sheets from contact with the registration member. The registration member can pass through a recess in the supply tray's side wall to directly abut against the opposed side of a received stack of sheets when the stack is fully received in the imaging apparatus.

3 Claims, 5 Drawing Sheets

SHEET MEDIA SUPPLY TRAY ORIENTS SHEETS TO REGISTRATION POSTS IN IMAGING APPARATUS

BACKGROUND OF THE INVENTION

1. Technical Field

The present invention relates to imaging apparatus, such as printers or copiers, having removable trays for sheet media.

2. Background Art

Copiers and printers often provide one or more removable sheet supply trays. Sheet supply trays are typically dedicated to a specific sheet size. For example, one tray may be designed to hold 8.5 inch by 11 inch sheets, another may hold 11 inch by 17 inch sheets, and yet another may hold A4 sheets, which are 210 mm by 297 mm. Unfortunately, the operator and the service personnel must have a selection of supply trays in order to utilize a variety of sheet sizes. This puts a storage and cost burden on the user, and increases the number of parts that service personnel must carry from customer to customer. It is therefore desirable to have a supply tray capable of holding multiple sheet sizes.

Typical sheet supply trays are often designed as an open-top box. Sheets are loaded into the tray by inserting them through the top of the tray and orienting the sheets so they are pressed against alignment features within the tray. When the tray is inserted into the imaging apparatus, the alignment of the sheets to the media transport mechanism of the imaging apparatus is affected both by the alignment of the receiver sheets to the tray and by the alignment of the tray to the media transport mechanism. In order to satisfy alignment requirements for the media transport mechanism, tolerances for the tray must be closely controlled. It is desirable to reduce the complexity of the imaging apparatus and the tray by reducing the buildup of alignment tolerances between sheets, tray and imaging apparatus. These alignment tolerances result in complex trays which have added manufacturing cost that increase the overall cost of owning the imaging apparatus. Therefore, it would be beneficial to reduce the complexity and cost of the tray.

The imaging apparatus may also determine which size sheet is loaded in a tray by mechanical or optical methods. Mechanical methods include holes, ribs or other tactile features which are part of a tray. Such tactile features engage sensors in the imaging apparatus, whereby the imaging apparatus determines information about the sheets that are loaded into the tray. Optical methods include presence or absence of optically detectable marks, location of marks, or bar codes which are detected using optical sensors. The imaging apparatus then determines information about the sheets loaded into the tray by the signals from the optical sensors, and adjusts its operation accordingly. Both mechanical and optical identification methods are inflexible, in that once a tray is marked or encoded, it is difficult for an operator to modify the marking. Thus a tray capable of holding a multiplicity of sheet sizes could not easily utilize mechanical or optical marking methods to indicate to the imaging apparatus information about the receiver sheets that are loaded in the tray. Furthermore, sensors for mechanical and optical marks tend to be more expensive than other sensor types. Therefore, it is desirable to have a flexible tray marking method capable of an unlimited number of user-adjusted changes of the marking. The flexible marking method should also be more economical to implement than alternative methods.

DISCLOSURE OF THE INVENTION

It is an object of the present invention to provide a less complex media supply tray that improves alignment of sheets to the media transport mechanism of an imaging apparatus.

This object is accomplished by a media supply tray that includes recesses in a side of the tray which allow registration features in the imaging apparatus to directly engage and align the sheets loaded in the tray with no intervening tray structure.

According to a feature of the present invention, imaging apparatus for receiving a stack of sheets includes a supply tray having a width alignment rail on one side of a generally rectangular cavity adapted to receive a stack of rectangular sheets, a registration member against which the side of a received stack of sheets opposed to the one side abuts when the stack is fully received in the imaging apparatus, urging means for moving the sheet supply tray and the width alignment rail toward the registration member with a resilient force when the sheet supply tray is being received in the imaging apparatus, and means for holding the sheet supply tray and the width alignment against the resilient force of the urging means until the sheet supply tray is substantially fully received in the imaging apparatus to keep the received stack of sheets from contact with the registration member until the sheet supply tray is substantially fully received in the imaging apparatus.

According to a preferred embodiment of the present invention, the supply tray further comprises a side wall on said opposed side of a received stack of sheets, the side wall defining a recess through which the registration member can pass to abut against the opposed side of a received stack of sheets when the stack is fully received in the imaging apparatus. The means for holding the sheet supply tray and the width alignment against the resilient force of the urging means comprises a cam and follower combination which prevents the tray from moving toward the registration member until the sheet supply tray is substantially fully received in the imaging apparatus.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
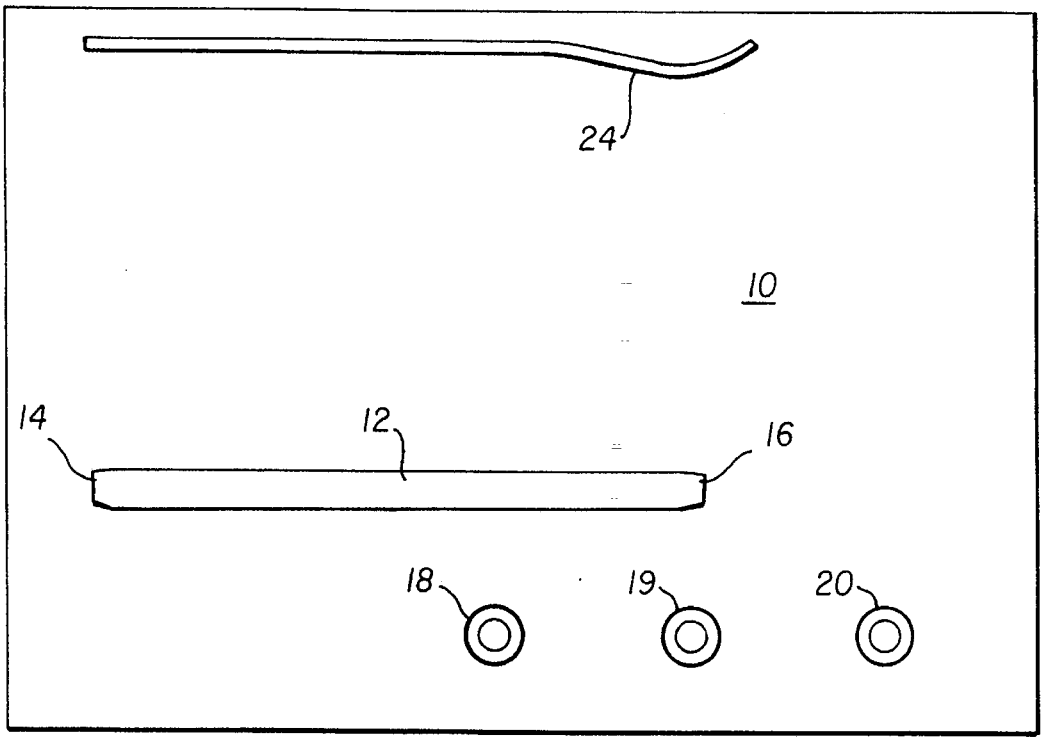
FIG. 1 shows a portion of an imaging apparatus that interfaces with a media supply tray, including a guide rail and registration posts.

FIG. 1 shows a portion of an imaging apparatus 10 that interfaces with a sheet media supply tray (not shown). The imaging apparatus includes a guide rail 12 which has first and second ends (14 and 16 respectively) and three registration posts 18, 19, and 20. A spring 24 provides a bias mechanism to urge a tray toward the registration posts.

Figure 2:
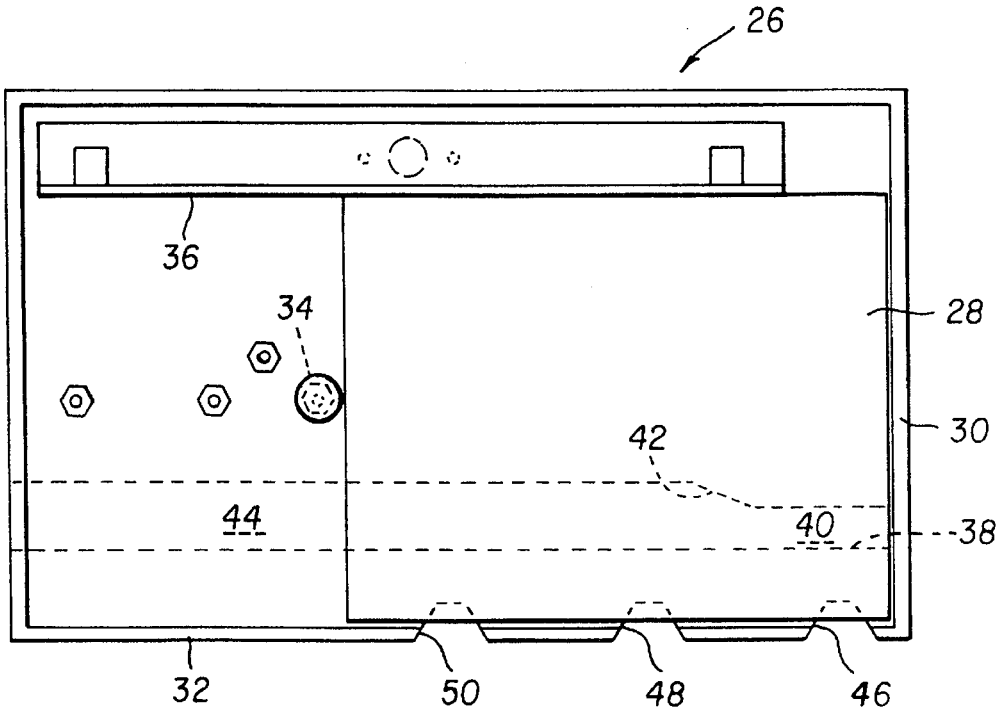
FIG. 2 shows a top view of a sheet media supply tray, including a guide channel and recesses.

FIG. 2 is a top view of sheet media supply tray 26. A stack 28 of sheets are loaded into tray 26 in close proximity to first and second sides 30 and 32, respectively, of the tray. A length-defining post 34, which has been inserted into one of a plurality of holes, and a width alignment rail 36 define the location of sheet stack 28, insuring proper orientation of the sheets.

A guide channel 38 located on the bottom of supply tray 26 includes a narrow portion 40, a cam surface 42, and an enlarged portion 44. Second side 32 of tray 26 includes one or more recesses 46, 48, and 50 which extend far enough into tray 26 to insure that a properly loaded stack 28 of sheets will overlap the recesses. These recesses allow the sheets to be engaged by printer features (discussed below) without those features engaging the tray.

Figure 3:
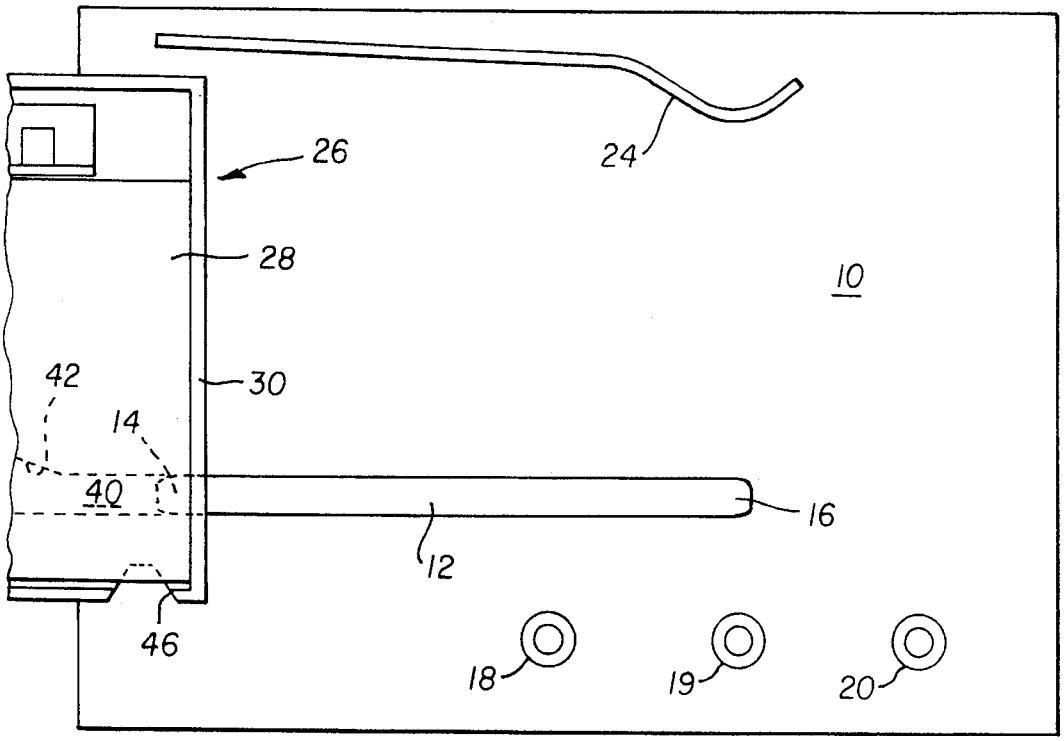
FIG. 3 shows the sheet media supply tray of FIG. 2 being inserted into the imaging apparatus of FIG. 1, where the guide channel initially engages the guide rail.
Figure 4:
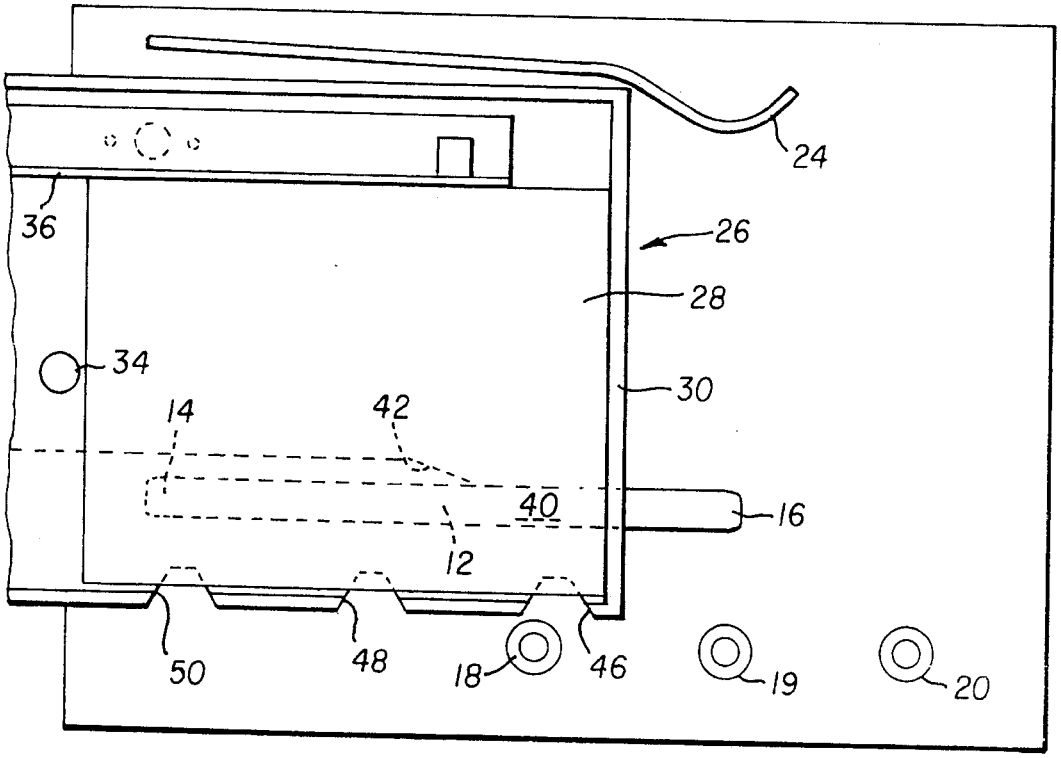
FIG. 4 shows the sheet media supply tray being inserted into the imaging apparatus, where the tray has advanced a distance into the imaging apparatus and the guide rail engages a narrow portion of the guide channel.

FIG. 3 shows tray 26 initially being inserted into imaging apparatus 10. After the user has properly loaded a stack 28 of sheets into tray 26, the user positions the tray so that first end 14 of guide rail 12 engages narrow portion 40 of guide channel 38. As the user pushes tray 26 into imaging apparatus 10 (FIG. 4), guide rail 12 follows narrow portion 40 of guide channel 38, limiting motion of tray 26 to linear travel into imaging apparatus 10.

Figure 5:
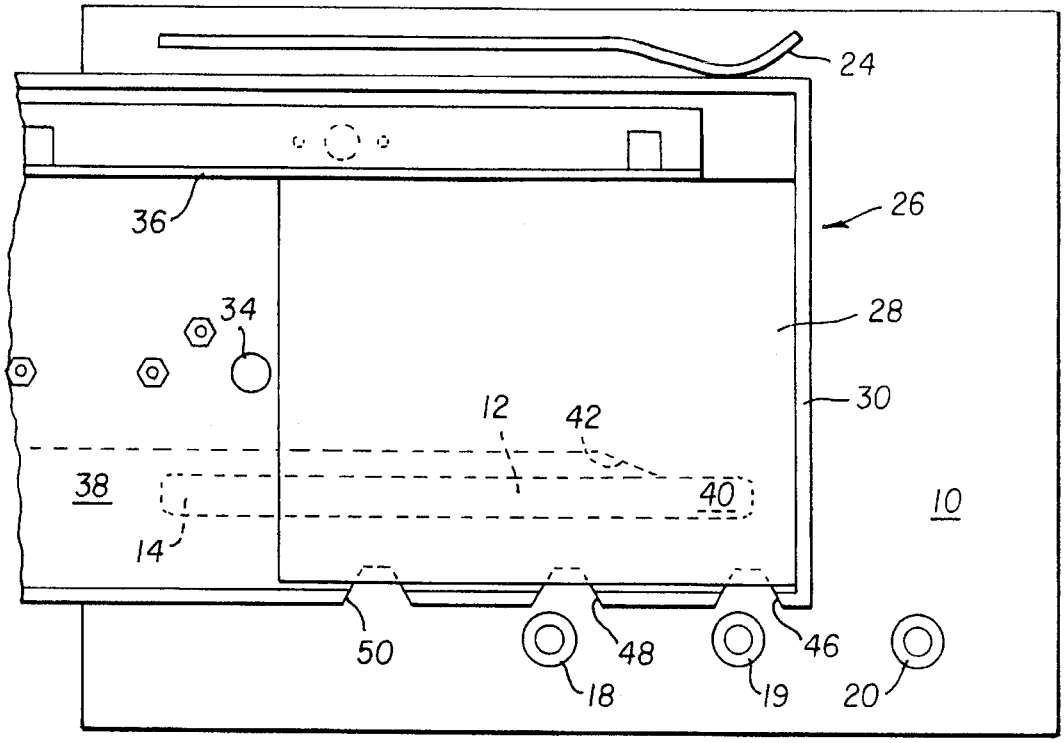
FIG. 5 shows the sheet media supply tray being inserted into the imaging apparatus, where the tray has further advanced into the imaging apparatus and engaged a spring which urges the tray to one side.

FIG. 5 shows that spring 24 is engaged by tray 26 as the tray moves further into imaging apparatus 10. Spring 24 urges the tray toward registration posts 18–20. However, the tray is prevented from moving toward the registration pins because guide rail 12 is still in narrow portion 40 of guide channel 38.

Figure 6:
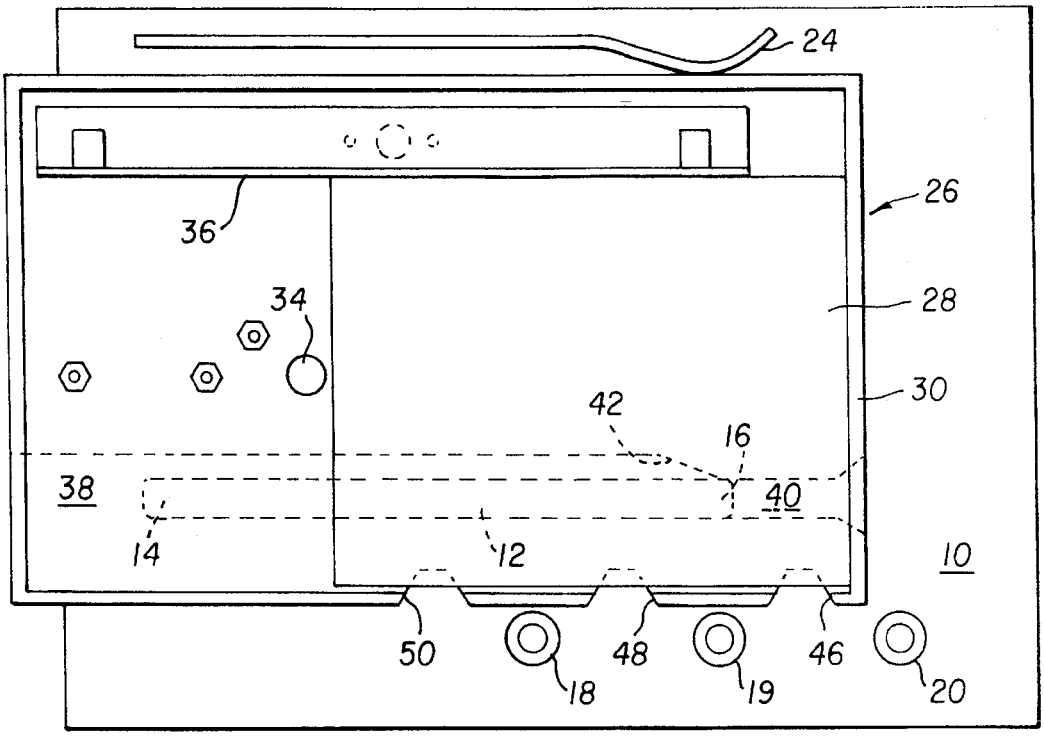
FIG. 6 shows the sheet media supply tray being inserted into the imaging apparatus, where the tray has further advanced into the imaging apparatus and the guide rail is at the end of the narrow portion of the guide channel.
Figure 7:
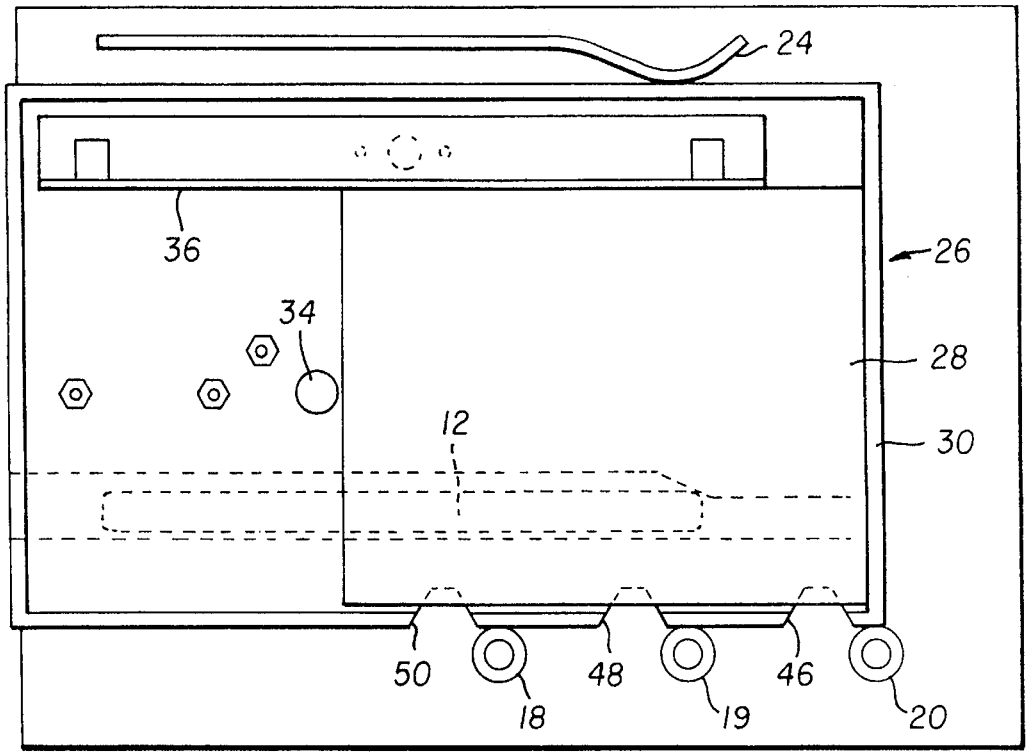
FIG. 7 shows the sheet media supply tray being inserted into the imaging apparatus, where the tray has further advanced into the imaging apparatus and the guide rail has entered an expanded portion of the guide channel, allowing the tray to engage the registration posts.

As the user continues to push tray 26 into imaging apparatus 10 (FIG. 6), second end 16 of guide rail 12 reaches cam surface 42 of guide channel 38. The force of spring 24 urges tray 26 toward registration posts 18–20 and second end 16 of guide rail 12 follows cam surface 42 for some distance. Second end 16 continues to follow cam surface 42 until tray side 32 engages registration posts 18–20. At this point, cam surface 42 of guide channel 38 moves away from second end 16 as tray 26 moves further into imaging apparatus 10 (FIG. 7). Additional motion of tray 26 into imaging apparatus 10 is now guided by registration posts 18–20 in contact with tray side 32.

Figure 8:
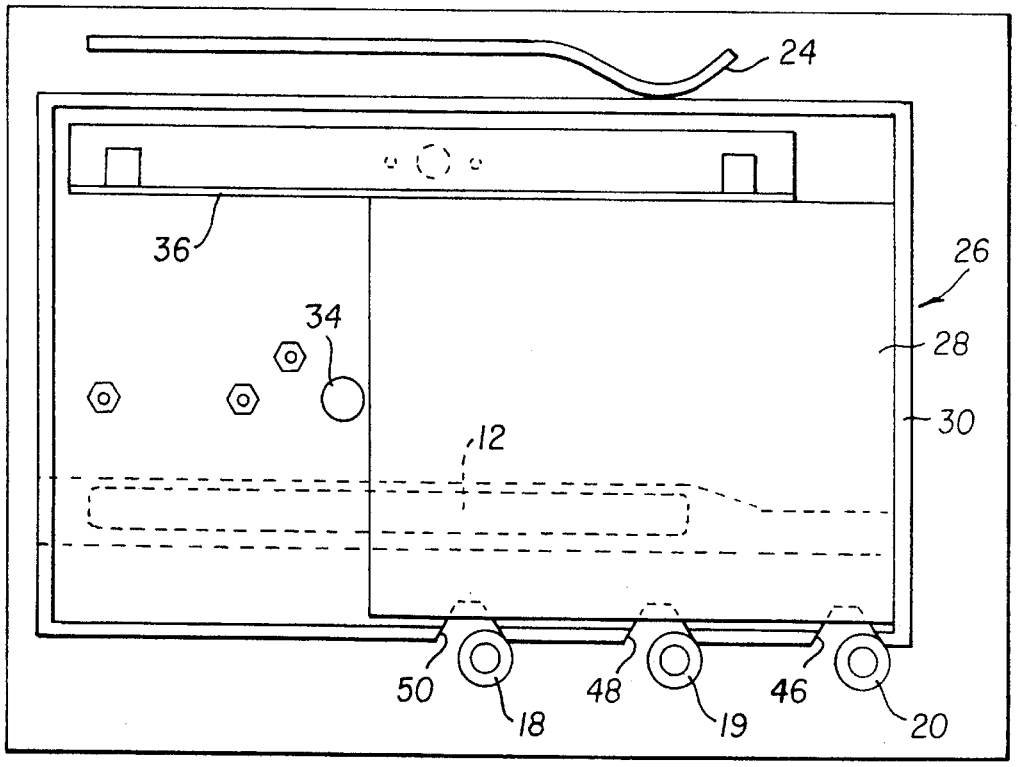
FIG. 8 shows the sheet media supply tray being inserted into the imaging apparatus, where the tray has further advanced into the imaging apparatus and the registration posts now engage cam surfaces which are part of recesses in the side of the tray.
Figure 9:
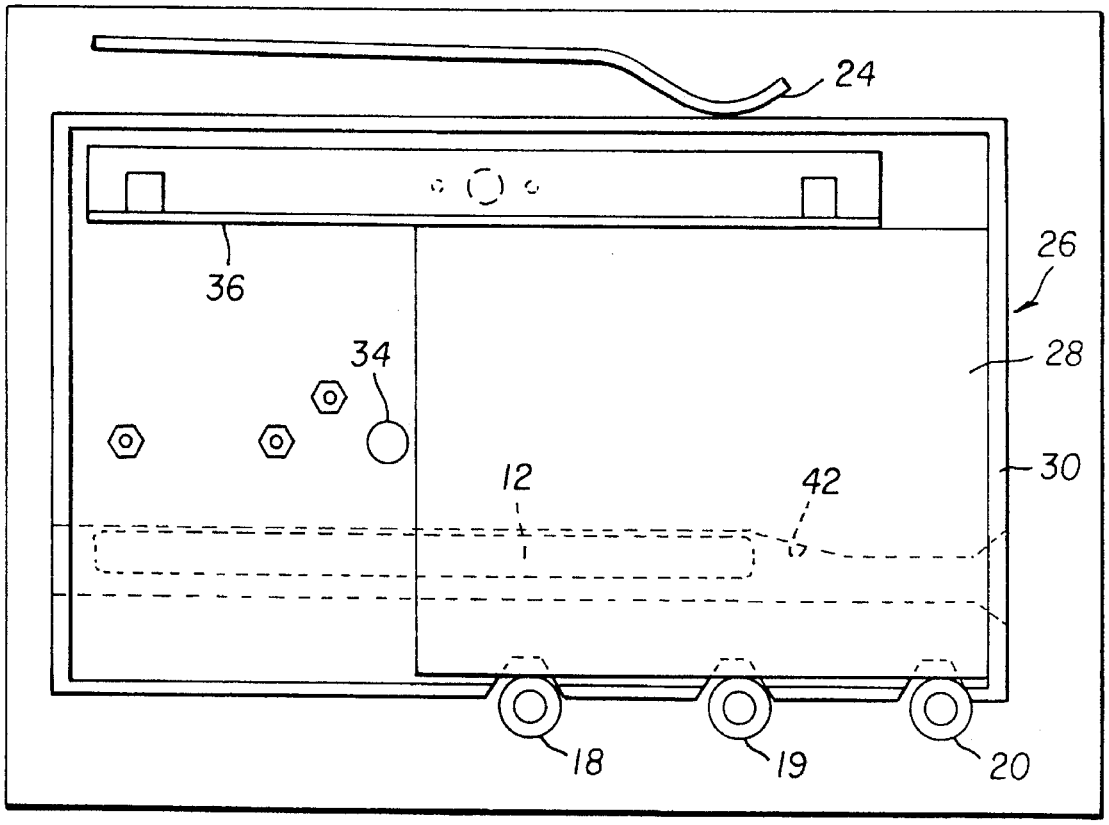
FIG. 9 shows the sheet media supply tray fully inserted into the imaging apparatus, where the tray has moved completely into the imaging apparatus and the registration posts now engage a side of the sheets loaded into the tray.

FIG. 8 depicts a point in time when tray 26 has moved into imaging apparatus 10 enough to allow registration posts 18–20 to contact leading cam surfaces of recesses 46, 48, and 50. Additional movement of tray 26 and the urging of spring 24 causes the registration posts to follow the recess cam surfaces until the registration posts engage stack 28 of media sheets, as illustrated in FIG. 9. Spring 24 applies force to tray 26, which is transferred through width alignment rail 36 to the stack of sheets. This force holds the sheets against registration posts 18–20 to insure accurate alignment of the sheets to the media transport mechanism of the imaging apparatus.

The invention has been described in detail with particular reference to certain preferred embodiments thereof, but it will be understood that variations and modifications can be effected within the spirit and scope of the invention.

ADVANTAGES

1. Media sheets are registered or aligned directly to a portion of the media transport mechanism of the imaging apparatus with no intervening portion of the media supply tray.

2. Media sheets do not contact registration posts 18–20, until the very last increment of travel of the supply tray, minimizing degradation to the receiver sheets by abrasion.

3. The cam surface on the guide channel controls the approach of the tray and receiver sheets to the registration posts, providing a controlled interface.

4. The cam surfaces on recesses 46, 48, and 50 control the approach of registration posts to the first contact with the media sheets.

5. Spring 24 provides an assured loading force which presses tray 26 against the media sheets, which are in turn pressed against the registration posts.

The invention has been described in detail with particular reference to preferred embodiments thereof, but it will be understood that variations and modifications can be effected within the spirit and scope of the invention.

What is claimed is:

1. Imaging apparatus for receiving a stack of sheets, said imaging apparatus comprising:

a sheet supply tray having a width alignment rail on one side of a generally rectangular cavity adapted to receive a stack of rectangular sheets;

a registration member against which the side of a received stack of sheets opposed to the one side directly abuts when the stack is fully received in the imaging apparatus;

urging means for moving the sheet supply tray and the width alignment rail toward the registration member with a resilient force when the sheet supply tray is being received in the imaging apparatus; and means for holding the sheet supply tray and the width alignment against the resilient force of the urging means until the sheet supply tray is substantially fully received in the imaging apparatus to keep the received stack of sheets from contact with the registration member until the sheet supply tray is substantially fully received in the imaging apparatus.

2. Imaging apparatus as set forth in claim 1 wherein said sheet supply tray further comprises a side wall on said opposed side of a received stack of sheets, said side wall defining a recess through which the registration member can pass to abut against the opposed side of a received stack of sheets when the stack is fully received in the imaging apparatus.

3. Imaging apparatus as set forth in claim 1 wherein said means for holding the sheet supply tray and the width alignment rail against the resilient force of the urging means comprises a cam and follower combination which prevents the tray from moving toward the registration member until the sheet supply tray is substantially fully received in the imaging apparatus.

* * * * *